US006109455A

United States Patent [19]

Schroeder

[11] Patent Number: 6,109,455

[45] Date of Patent: Aug. 29, 2000

[54] CROCKERY BASKET FOR A DISHWASHING MACHINE

[75] Inventor: Manfred Schroeder, Saarbrüchen, Germany

[73] Assignee: Whirlpool Corporation, Benton Harbor, Mich.

[21] Appl. No.: 09/138,222

[22] Filed: Aug. 21, 1998

[30] Foreign Application Priority Data

Aug. 23, 1997 [DE] Germany ..... 197 36 793

[51] Int. Cl.[7] ..... A47G 19/08

[52] U.S. Cl. ..... 211/41.9

[58] Field of Search ..... 211/41.9, 41.1, 211/41.2, 41.3, 41.5, 41.6, 41.4

[56] References Cited

U.S. PATENT DOCUMENTS 3,349,924 10/1967 Maurer et al. ..... 211/41.1
4,635,799 1/1987 Penner ..... 211/41.9
5,154,299 10/1992 Hwang ..... 211/41.1
5,332,105 7/1994 Stanfield ..... 211/41.4
5,799,802 9/1998 Delia et al. ..... 211/41.2

*Primary Examiner*—Alvin Chin-Shue
*Assistant Examiner*—Sarah Purol
*Attorney, Agent, or Firm*—Joel M. Van Winkle; Robert O. Rice; Stephen D. Krefman

[57] ABSTRACT

The invention relates to a crockery basket for a dishwashing machine with a supporting frame into which adapted inserts may be introduced for various items such as cutlery, crockery and similar. An optimal, flexibly constructable fitting out of the crockery basket with crockery items is achieved according to the invention by virtue of the fact that the supporting frame is designed as a wire crockery basket, that all the inserts have a uniformly sized surface area with a base width and a base depth and that the wire crockery basket forms a right-angled receiving means for the inserts, the width of which corresponds to an x-multiple of the base width and the depth of which corresponds to a y-multiple of the base depth of the inserts.

11 Claims, 6 Drawing Sheets

CROCKERY BASKET FOR A DISHWASHING MACHINE

BACKGROUND OF THE INVENTION

1. Field of the Invention

The invention relates to a crockery basket for a dishwashing machine with a supporting frame into which adapted inserts may be introduced for various items such as cutlery, crockery and similar.

2. Description of the Related Art

A crockery basket of this type is known from DE-OS 14 03 633. The supporting frame is thereby divided into three receiving compartments of various sizes for the inserts. The inserts are designed as different types for receiving crockery or cutlery and may be used according to choice in the receiving compartments of the supporting frame. The inserts are different with respect to their size and/or their mode of construction. The inserts may be removed from the supporting frame with the cutlery or crockery items, however they have a fixed place in the supporting frame in order to preclude a transposition of the units within the supporting frame. According to a further development, there may also be inserted into or mounted onto an insert itself one or several part inserts, which are similar in their size and outline, with similar or different mountings.

This known crockery basket indeed offers the advantage that handling of the inserts is facilitated and a certain accommodation of the crockery basket to various types of crockery is possible.

SUMMARY OF THE INVENTION

It is the object of the invention to devise a crockery basket of the type mentioned at the beginning in such a way that a flexible configuration of the crockery basket with inserts for various crockery items is achieved.

This object is resolved according to the invention in that the supporting frame is designed as a wire crockery basket, in that all the inserts have a uniformly sized surface area with a base width and a base depth and in that the wire crockery basket forms a right-angled receiving means for the inserts, the width of which corresponds to an x multiple of the base width and the depth of which corresponds to a y multiple of the base depth of the inserts.

With this development and adaptation of a wire crockery basket and the inserts, a universal configuration of the crockery basket is achieved which may be accommodated in an optimal fashion to the crockery items to be washed. The wire crockery basket has x.y receiving positions for any inserts, positions of the wire crockery basket which are not being used also having the capacity to remain empty for receiving pots, dishes and similar. Thereby, the positions which are left empty may be as large as desired and situated at any point in the wire crockery basket. The flexibility is increased even more in that the inserts at any point in the wire crockery basket, which is grid-like and which can be fitted out according choice, may be inserted in two positions which are rotated by 180°.

According to one development, all the inserts have a uniformly sized basic frame, on which various mountings for various cutlery crockery and cutlery items are arranged. The crockery items which are contained in the inserts can then remain throughout in place for the rinsing water to dry off.

A versatile embodiment option for the various inserts results from designing and producing the inserts as integral plastic injection moulded parts.

A set of varying, equally sized inserts is added to the wire crockery basket in order that it can be fitted out as desired.

There can be inserts provided which are designed as mesh cutlery baskets with carrying elements and which are divided into three receiving compartments for knives, forks and spoons.

In addition, inserts can be provided which are designed as cup and/or plate racks and which have a series of spaced holding webs. The holding webs have two connected web sections, one of which slopes gently and the other steeply to the longitudinal sides of the basic frame of the insert. Between the holding webs, plates can be placed and cups can be put on the gently sloping web sections of the holding webs. The holding webs are preferably aligned parallel to one another and sloping relative to the narrow sides and/or the plane of the basic frame of the insert. If two inserts of this type are arranged in such a way to one another that the flat web sections are facing towards one another, then plate receiving means result between the holding webs of the adjacent inserts, said plate receiving means being accommodated to the cross-section of the plate.

In order to increase the flexibility even more, inserts are also provided which are designed as glass holders and which have a mounting which is formed via vertical supports to the basic frame and which is provided with several glass-stem receiving means. The mounting stands thereby above the basic frame and extends parallel to its longitudinal sides. According to a further development, holding webs are formed on the basic frame spaced between the supports, said holding webs consisting of two web sections, one of which slopes gently and the other steeply to the longitudinal sides of the basic frame; then cups too may be placed into these inserts which are designed as glass holders.

According to a further development the narrow sides of the basic frame of cup and/or plate racks may be provided with pairs of receiving holes for inserting a separate glass-stem holder, so that large glasses can be better held via two adjacent inserts. The glass-stem holder is formed similarly thereby to the mounting of the glass holder.

BRIEF DESCRIPTION OF THE DRAWINGS

The invention is described in greater detail with reference to various embodiments, given by way of example, which are represented in the drawings which show.

DESCRIPTION OF THE PREFERRED EMBODIMENT

Figure 1:
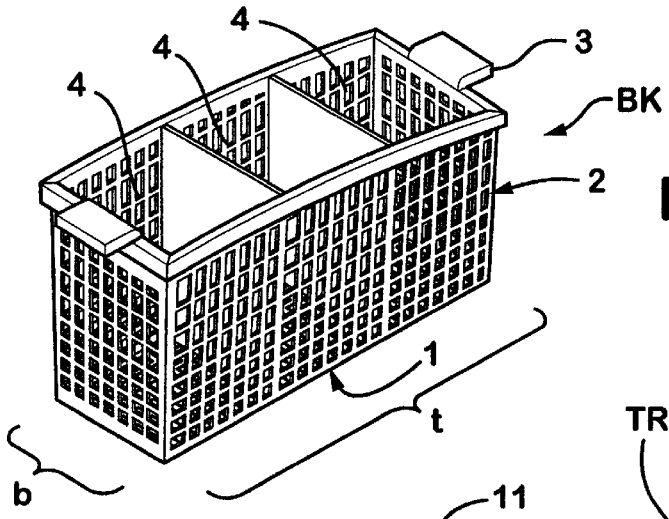
FIG. 1 an insert designed as a cutlery basket.

In FIGS. 1 to 5 variously shaped inserts are shown which are provided with an equal sized surface area and which are added as a set to a crockery basket according to the invention. FIG. 1 shows an insert BK, designed as a cutlery basket, with a basic frame 1 which has a base width b and a base depth t. The wall parts 2 of the cutlery basket are designed like a mesh and are provided with carrying elements 3 on the narrow sides.

The insert BK, designed as a cutlery basket, is divided into three receiving compartments 4 for knives, forks and spoons. Said cutlery basket may be produced as an integral plastic injection moulded part at a reasonable price.

Figure 2:
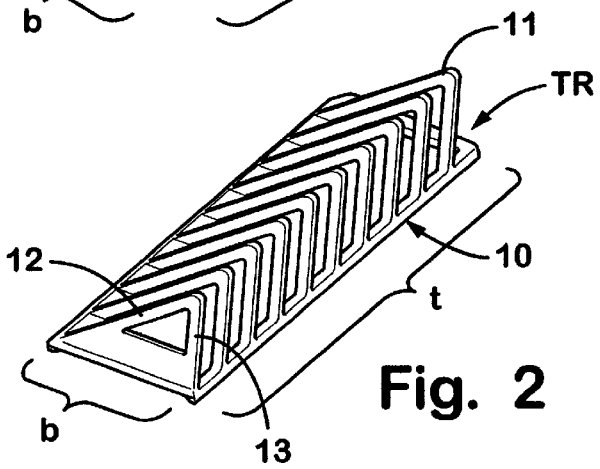
FIG. 2 an insert designed as a cup and/or plate rack in perspective view.
Figure 3:
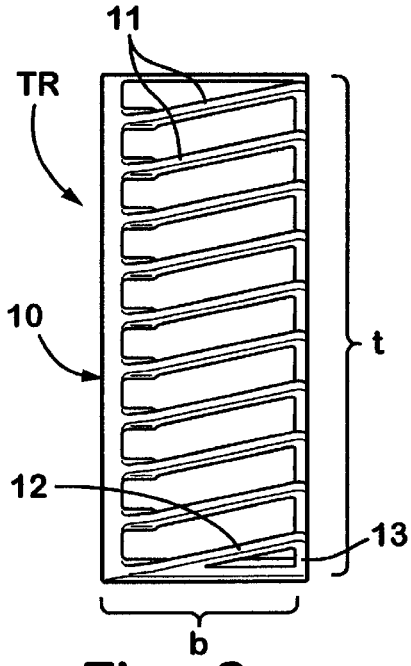
FIG. 3 the insert according to FIG. 2 in plan view.

The insert TR, which is designed as a plate and/or cup rack and shown in FIGS. 2 and 3, likewise has a basic frame 10 with the dimensions base width b and base depth t. Several holding webs 11 which extend parallel to one another and which have two connected together web sections 12 and 13 are formed on the basic frame 10. The web section 12 slopes gently and the web section 13 steeply to the facing longitudinal side of the basic frame 10 with the result that the web sections 12 form an intermittent placing surface for cups. As can be seen from the plan view according to FIG. 3, the holding webs 11 are sloped towards the narrow sides of the insert. They car also easily deviate from the vertical relative to the plane of the basic frame 10. The insert TR which is designed as a plate and/or cup rack forms several receiving means between the holding webs 11, which can contain the edge of a plate in such a way that the latter stands parallel to the narrow sides of the insert when in place. The diagonal position of the plate is different according to the shape of the plate (deep or shallow).

Figure 4:
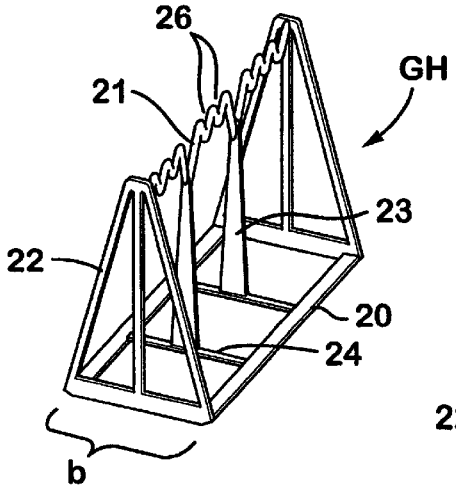
FIG. 4 a first variant for an insert designed as a glass holder in perspective view, FIG. 5 a second variant for a glass holder with cup holder in perspective view, FIG. 6 a crockery basket fitted with 10 plates and/or cup rack in perspective view, FIG. 7 the crockery basket filled according to FIG. 6 with plates, cups and bowls, FIG. 8 the filled crockery basket according to FIG. 7 in plan view, one position of the wire crockery basket not being filled with an insert, FIG. 9 the crockery basket fitted out with a cutlery basket, a glass holder and seven plates and/or cup racks in perspective view and FIG. 10 a view on the front side of the wire crockery basket, according to FIG. 9, filled with crockery items.

In FIG. 4 an insert GH is shown which is designed as a glass holder and the basic frame 20 of which shows the base width b and the base depth t. Formed on this basic frame 20 there are vertical supports 22 and 23, which bear a horizontal mounting 21 with several glass-stem receiving means 26 for glasses. The mounting 21 extends parallel to the longitudinal sides of the basic frame 20 and stands centrally above the latter. The supports 23 are formed below on transverse webs 24.

Figure 5:
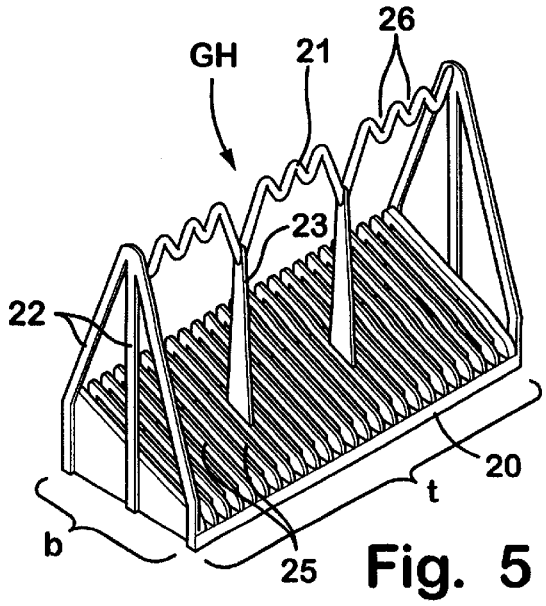

As FIG. 5 shows, holding webs 25 can be formed on the basic frame 20 between the supports 22 and 23, said holding webs 25 being designed and aligned like the holding webs 11 of the insert according to FIGS. 2 and 3. The holding webs 28 may then be used for containing cups.

The inserts TR and GH according to FIGS. 2 to 5 can be produced as simple plastic injection moulded parts at a reasonable price.

Figure 6:
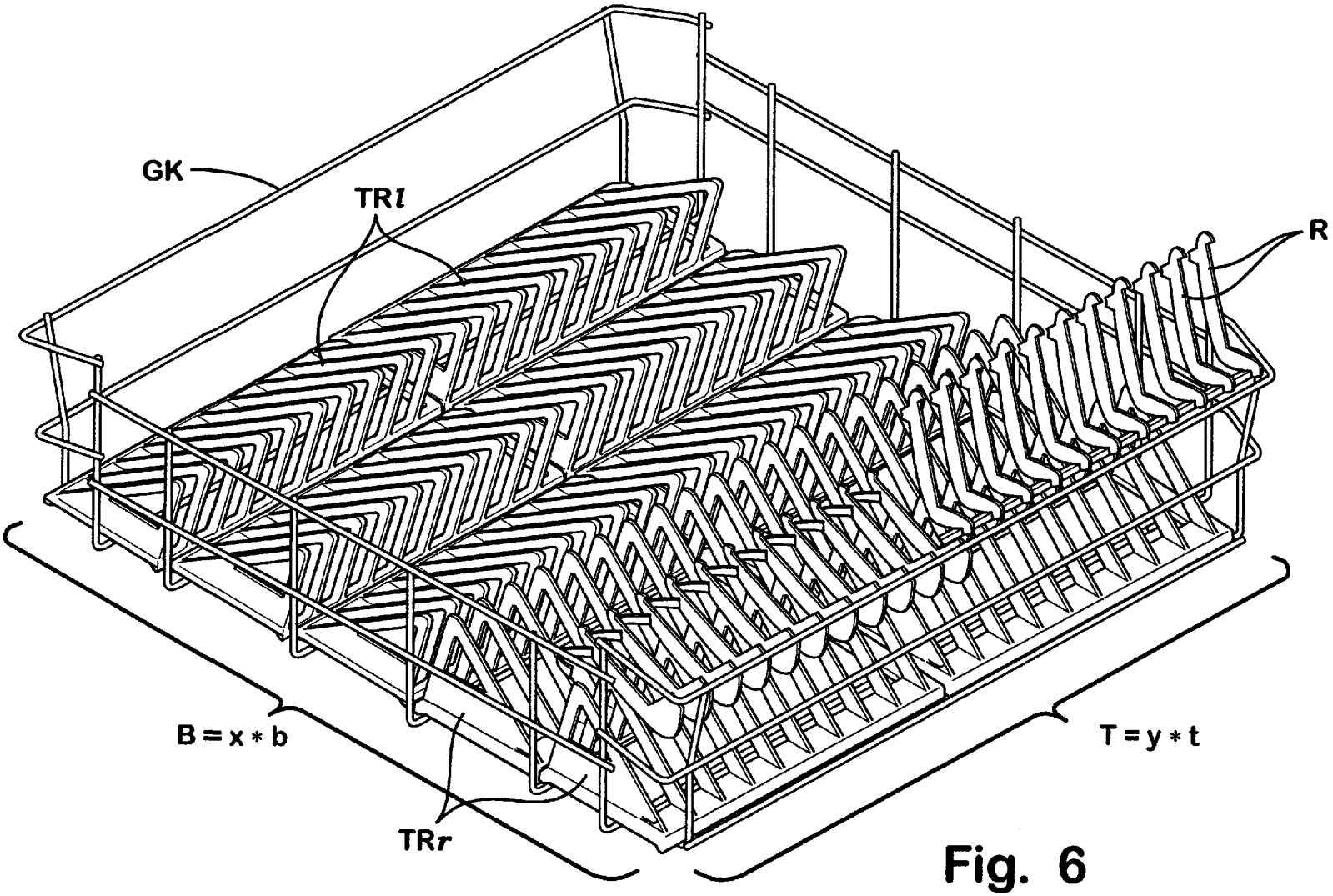

As FIG. 6 shows, the supporting frame of the crockery basket is designed as a wire crockery basket GK which forms an undivided receiving means for inserts according to FIGS. 1 to 5, said receiving means have a width B of x.b and a depth T of y.t. Hence inserts x.y may be installed in the wire crockery basket and in fact any inserts in any positions of the receiving means. In the embodiment, x=5 and y=2 so that, with 10 positions, a large choice of variation is offered in the fitting out of the crockery basket. In FIG. 6, the crockery basket is fitted out with 10 inserts TR which are designed as a plate and/or a cup rack.

The insert position of the insert TR with web sections of the holding webs sloping gently to the left or to the right are characterised with the descriptions TRl and TRr. Already known holding racks R can be installed movably in the wire crockery basket GK and can be used for further receiving and/or holding crockery items which have been put in.

Figure 7:
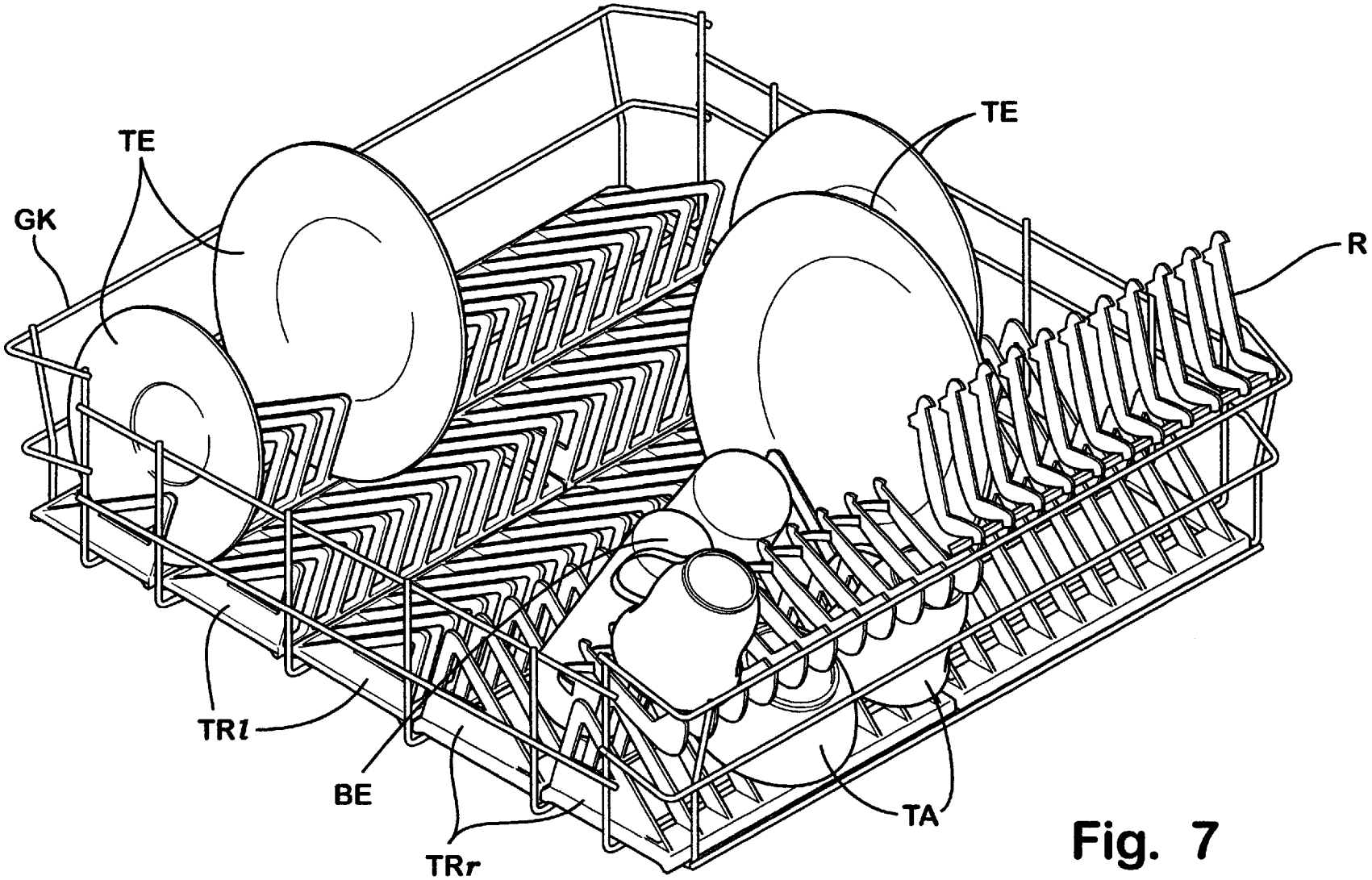

As FIG. 7 shows, the wire crockery basket GK which according to FIG. 6 is fitted with inserts TR in the insert positions TRl or TRr can be loaded with plates TE, cups TA and bowls BE. A diminished holding rack R can thereby be used as a place for cups in addition. The plates TE are placed between the holding webs of the inserts TR, it being possible for large plates to be held also by two longitudinally adjacent inserts TRl and TRr. The cups TA and the bowls BE can be placed also on the gently sloping web sections of the flat web sections of the inserts TRl and TRr which are directed to the left or the right.

Figure 8:
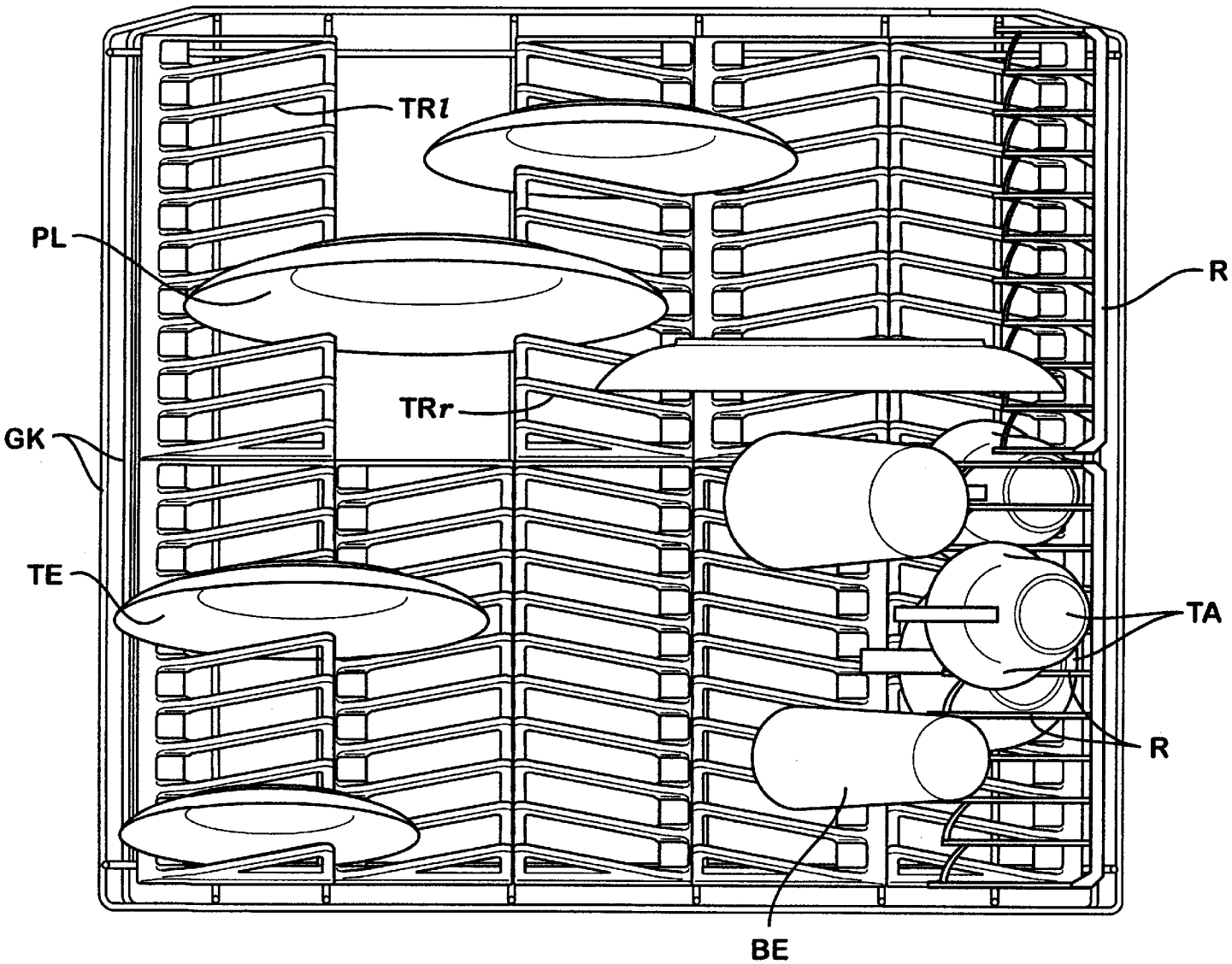

As FIG. 8 shows, there are positions of the wire crockery basket GK which can have no inserts installed. Large platters PL may thereby be put in two inserts which are adjacent on their longitudinal sides across an empty position. The empty positions can be used at any point and be of any size for placing pots dishes and similar. As FIG. 8 shows, the inserts TR can be used in any alignment TRl and TRr.

Figure 9:
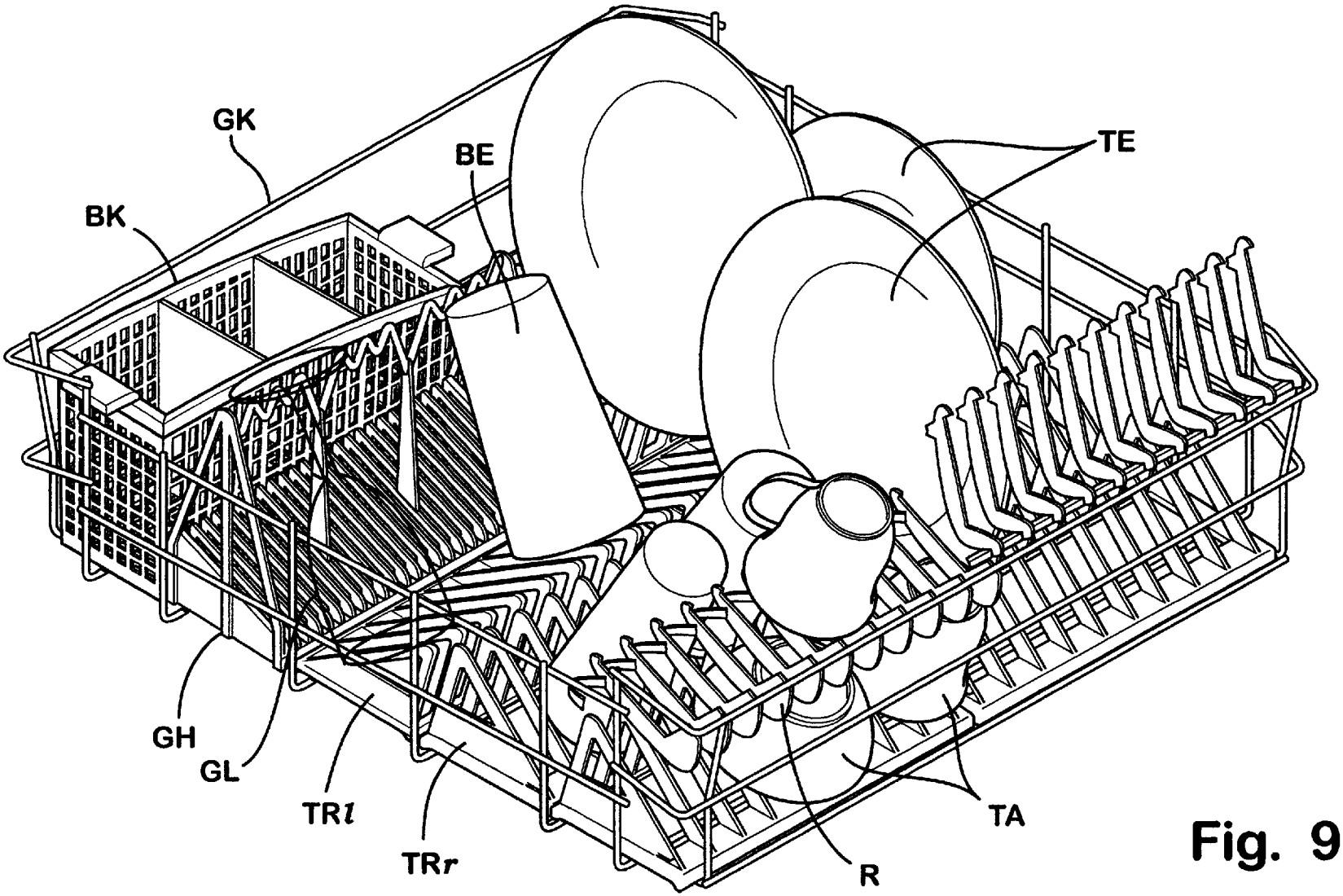
Figure 10:
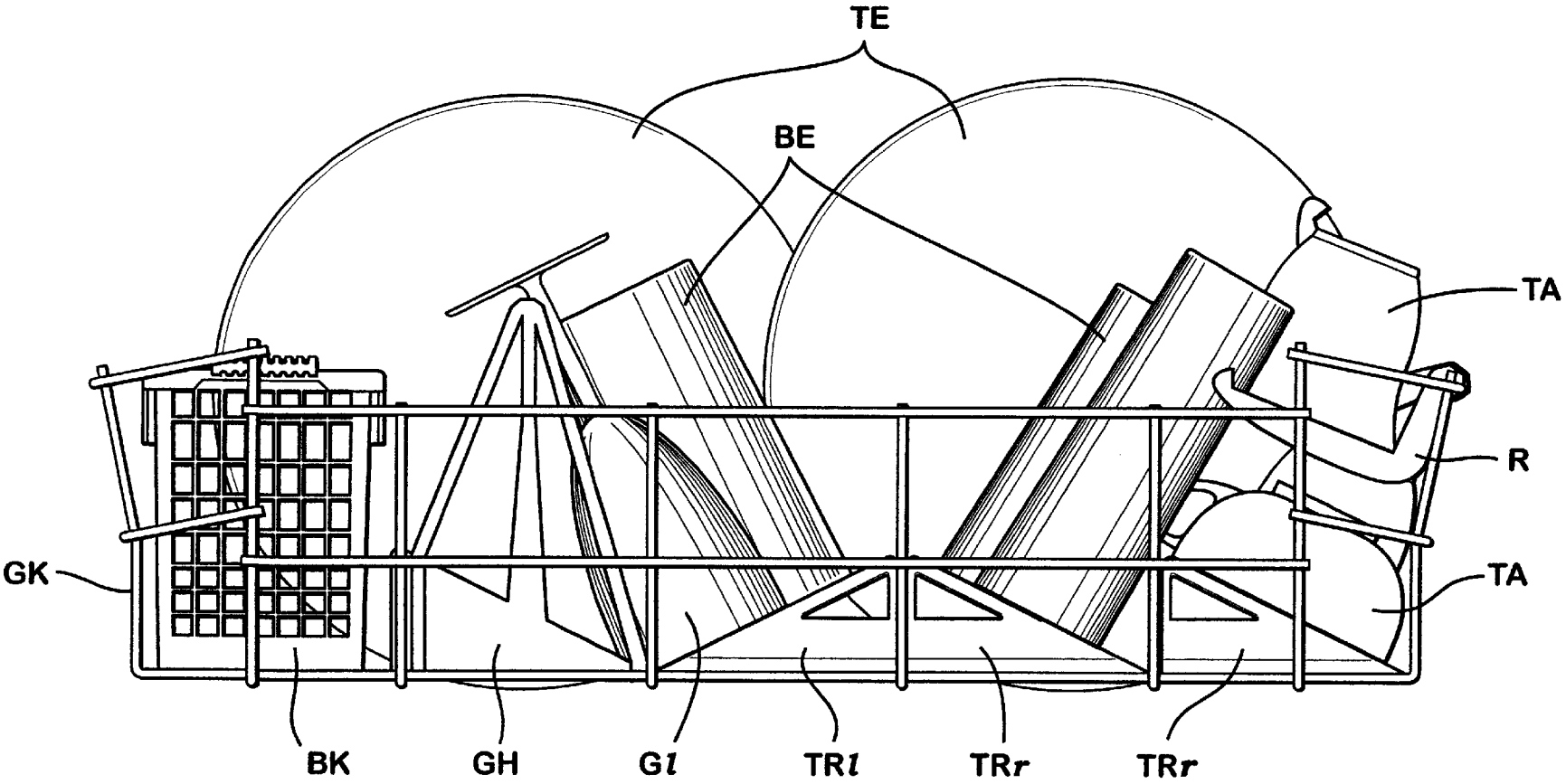

When the wire crockery basket GK is fitted out according to FIGS. 9 and 10, there are in the one row an insert BK designed as a cutlery basket, an insert GH designed as a glass holder and three units TR designed as a plate and/or cup rack, arranged with the alignments TRl, TRr and TRr. The row situated behind is fitted, as with the embodiment according to FIG. 8, with four inserts TR designed as a plate and/or cup rack in the alignments TRl, TRr, TRl and TRr, a position in the wire crockery basket GK between the first and second insert TR being left empty.

The insert GH designed as a glass holder in the first row is thereby used as an additional mounting for glasses GL and bowls BE, which are placed on the abutting insert TR in the alignment TRl. The bowls BE which are placed on the last but one insert Tr of this row in the alignment TRl are held additionally by the swivelled holding rack R. This holding rack also serves as a possible place for cups TA, like the insert TR situated underneath in the alignment TRr.

I claim:

1. A crockery basket for a dishwashing machine comprising:

a supporting frame forming a surrounding wire frame and an undivided center area; and a plurality of adapted inserts which may be installed in the undivided center area of the supporting frame for supporting various items such as cutlery, crockery and similar, wherein the inserts have a uniformly sized surface area with a base width and a base depth and the supporting frame forms a right-angled receiving means for the inserts, the width of which corresponds to an x-multiple of the base width and the depth of which corresponds to a y-multiple of the base depth of the inserts.

2. The crockery basket according to claim 1, wherein the inserts have a uniformly sized basic frame on which various mountings for various cutlery or crockery items are formed.

3. The crockery basket according to claim 1, wherein the inserts are designed and produced as integral plastic injection moulded parts.

4. The crockery basket according to claim 1, wherein inserts are provided which are designed as a lattice cutlery basket with carrying elements and are divided into three receiving compartments.

5. The crockery basket according to claim 1, wherein inserts are provided which are designed as a cup and/or plate rack and carry a series of spaced holding webs.

6. The crockery basket according to claim 5, wherein the holding webs have two interconnected web sections one of which extends with a gentle slope and the other with a steep slope to the longitudinal sides of the basic frame.

7. The crockery basket according to claim 5, wherein the holding webs are aligned parallel to one another and are inclined towards the narrow sides and/or the plane of the basic frame.

8. The crockery basket according to claim 1, wherein inserts are used which are designed as glass holders and have a mounting which is formed via vertical supports on the basic frame and which is provided with several glass-stem receiving means.

9. The crockery basket according to claim 8, wherein spaced holding webs are formed on the basic frame between the supports, said holding webs comprising two web sections, one of which slopes gently and the other steeply to the longitudinal sides of the basic frame.

10. The crockery basket according to claim 1, wherein the inserts at any point in the wire crockery basket which is grid-like and can be fitted out according to choice can be inserted in two positions which can be rotated by 180°.

11. The crockery basket according to claim 5, wherein the narrow sides of the basic frame of a cup and/or plate rack are provided with pairs of receiving holes for putting in a separate glass-stem holder.

* * * * *